US011834844B2

(12) United States Patent
Perra

(10) Patent No.: US 11,834,844 B2
(45) Date of Patent: Dec. 5, 2023

(54) FLOORING PANEL AND A FLOOR COVERING WITH SUCH PANEL

(71) Applicant: I4F LICENSING NV, Hamont-Achel (BE)

(72) Inventor: Antonio Giuseppe Perra, Bergen (NL)

(73) Assignee: i4F Licensing NV, Turnhout (BE)

( * ) Notice: Subject to any disclaimer, the term of this patent is extended or adjusted under 35 U.S.C. 154(b) by 23 days.

(21) Appl. No.: 17/427,013

(22) PCT Filed: Jan. 30, 2019

(86) PCT No.: PCT/NL2019/050056
§ 371 (c)(1),
(2) Date: Jul. 29, 2021

(87) PCT Pub. No.: WO2020/159354
PCT Pub. Date: Aug. 6, 2020

(65) Prior Publication Data

US 2022/0120093 A1 Apr. 21, 2022

(51) Int. Cl.
*E04F 15/00* (2006.01)
*E04F 15/02* (2006.01)
*E04F 15/10* (2006.01)

(52) U.S. Cl.
CPC ..... *E04F 15/02038* (2013.01); *E04F 15/102* (2013.01); *E04F 15/107* (2013.01); *E04F 2201/026* (2013.01); *E04F 2201/027* (2013.01)

(58) Field of Classification Search
CPC ..... E04F 15/02033; E04F 15/02038; E04F 15/107; E04F 15/102; E04F 2201/042; E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; E04F 15/02005; E04F 2201/0115; E04F 2201/0161; E04F 2201/026; E04F 2201/027
See application file for complete search history.

(56) References Cited

U.S. PATENT DOCUMENTS 6,216,409 B1 * 4/2001 Roy ..... E04F 15/04 52/592.4
6,685,391 B1 * 2/2004 Gideon ..... E02B 3/14 405/20
7,131,242 B2 * 11/2006 Martensson ..... E04F 15/02 52/592.1
8,806,832 B2 * 8/2014 Kell ..... E04F 15/107 52/592.4
9,885,187 B2 * 2/2018 Kell ..... E04F 15/02033
(Continued)

FOREIGN PATENT DOCUMENTS

AU 2006201668 A1 5/2006
DE 19933343 A1 2/2001
(Continued)

*Primary Examiner* — Chi Q Nguyen
(74) *Attorney, Agent, or Firm* — THE WEBB LAW FIRM

(57) ABSTRACT

A panel configured to be used for constructing a floor covering that includes a plurality of such panels. A combination of locking elements is used on the flanks of the coupling profiles on the sides of the panel that provides for replacing the well-known tongue and groove coupling.

21 Claims, 7 Drawing Sheets

(56) References Cited

U.S. PATENT DOCUMENTS

| | | | | |
|---|---|---|---|---|
| 10,738,477 | B2 | 8/2020 | Hannig | |
| 10,844,612 | B2 | 11/2020 | Boo | |
| 10,865,571 | B2 * | 12/2020 | Kell | E04F 13/0889 |
| 11,015,351 | B2 * | 5/2021 | De Rick | E04F 15/107 |
| 2007/0266666 | A1 | 11/2007 | Dammers | |
| 2013/0309441 | A1 * | 11/2013 | Hannig | E04F 15/102<br>29/428 |
| 2015/0240500 | A1 * | 8/2015 | Stevens, Jr. | E04F 15/105<br>52/588.1 |
| 2015/0292216 | A1 | 10/2015 | St-Laurent | |
| 2017/0241138 | A1 * | 8/2017 | Cornelus | D03D 15/283 |
| 2022/0025658 | A1 * | 1/2022 | Kell | E04F 15/0215 |

FOREIGN PATENT DOCUMENTS

| | | | | |
|---|---|---|---|---|
| DE | 10120062 | A1 | 11/2002 | |
| EP | 1549486 | B1 | 5/2010 | |
| EP | 2754772 | A1 | 7/2014 | |
| EP | 3031998 | A1 | 6/2016 | |
| JP | 2005535809 | A | 11/2005 | |
| JP | 2016516926 | A | 6/2016 | |
| KR | 1020210134647 | * | 1/2019 | E04F 15/02038 |

* cited by examiner

FLOORING PANEL AND A FLOOR COVERING WITH SUCH PANEL

CROSS-REFERENCE TO RELATED APPLICATION

This application is the United States national phase of International Application No. PCT/NL2019/050056 filed Jan. 30, 2019, the disclosure of which is hereby incorporated by reference in its entirety.

BACKGROUND OF THE INVENTION

Field of the Invention

The present invention is related to a panel configured to be used for constructing a floor covering that comprises a plurality of such panels. The invention particularly relates to laminated floor panels of which the core is made from at least one of a medium-density fiberboard (MDF) and a high-density fiberboard (HDF). However, the invention does not exclude panels made of different materials such as poly-vinyl-chloride (PVC), other types of synthetic materials, or panels made from wood such as engineered or solid wood panels. Furthermore, the panels of the invention could also be used for creating a wall covering.

Description of Related Art

A schematic overview and corresponding cross section of an exemplary embodiment of a panel 1 as described is shown in FIGS. 1A and 1B, respectively. Panel 1 comprises a core 2 having a first side that is provided with a first extension region 3 and a second side that is provided with a second extension region 4. Here, it is noted that the first side is oppositely arranged relative to the second side.

First extension region 3 comprises a first coupling profile 5 and second extension region 4 comprises a second coupling profile 6 that is complementary to first coupling profile 5. First coupling profile 5 of panel 1 can be coupled to second coupling profile 6 of an adjacent panel for the purpose of mutually locking panel 1 and the adjacent panel.

First coupling profile 5 and second coupling profile 6 each comprise a first flank 30, 31 that forms an inner flank of core 2, a third flank 50, 51 that forms a respective outer edge of panel 1, and a second flank 40, 41 that connects first flank 30, 31 and third flank 50, 51.

To enable first coupling profile 5 of panel 1 and second coupling profile 6 of an adjacent panel to be coupled for mutually locking panel 1 and the adjacent panel, locking elements are provided. More in particular, second flank 40 comprises a first locking element, schematically illustrated by dashed box B1, and second flank 41 comprises a second locking element, schematically illustrated by dashed box B2.

As shown, extension regions exist on all sides of panel 1. As an example, a cross section of panel 1 taken along a direction perpendicular to the direction along which the cross section of FIG. 1B was obtained may be similar to the cross section shown in FIG. 1B. More in particular, a first coupling profile may be provided on two sides of panel 1, whereas a second coupling profile may be provided on the other two sides of panel 1. The first coupling profiles may be identical to each other and the second coupling profiles may be identical to each other. Alternatively, different coupling profiles are used on different sides.

FIG. 2 illustrates an example of locking elements as used in the panel disclosed in EP3031998B1. This figure illustrates first coupling profile 5 of a panel 1 and second coupling profile 6 of an adjacent identical panel 1', which is identical to second coupling profile 6 of panel 1. Similar to the embodiment shown in FIG. 1A, first coupling profile 5 comprises a first flank 30 that forms an inner flank of core 2, a third flank 50 that forms an outer edge of panel 1, and a second flank 40 that connects the first and third flanks 30, 50. Second coupling profile 6 comprises a first flank 31 that forms an inner flank of core 2, a third flank 51 that forms an outer edge of panel 1, and a second flank 41 that connects the first and third flanks 31, 51.

As shown, second flanks 40, 41 are profiled. More in particular, second flank 40 comprises a protrusion 7 and a recess 8 that are complementary to a recess 9 and protrusion 10 comprised in second flank 41. In this manner, an upward tongue 7 is formed that runs at a distance from and parallel to first flank 30. A clearance between first flank 30 of core 2 and upward tongue 7 forms an upward groove 8. Similarly, second flank 41 comprises a downward tongue 10 that runs at a distance from and parallel to first flank 31. A clearance between first flank 31 and downward tongue 10 forms a downward groove 9.

In a locked state, first flank 30 of panel 1 is aligned with third flank 51 of adjacent panel 1', second flank 40 of panel 1 is aligned with second flank 41 of adjacent panel 1', and third flank 50 of panel 1 is aligned with first flank 31 of adjacent panel 1'.

The coupling profiles shown in FIG. 2 are known as a tongue-and-groove coupling. These coupling profiles often used in laminated floor panels. Unfortunately, the manufacturing of such panels can be costly and/or complex. Moreover, the locking between adjacent panels using the known tongue-and-groove coupling can be too weak to prevent gaps from appearing under the influence of moisture and/or temperature variations.

SUMMARY OF THE INVENTION

An object of the present invention is provide a floor panel in which the abovementioned problems do not occur or at least to a lesser extent.

This object is achieved with the panel as described which is characterized in that the first locking element comprises a recess extending inwardly relative to the second flank of the first or second coupling profile. This recess has a bottom and side walls extending from the bottom to an outside of the relevant second flank. The first locking element further comprises a protruding portion extending from the bottom toward the outside of the relevant second flank.

The second locking element comprises a protruding portion comprising side walls that extend outwardly from an outside of the second flank of the second or first coupling profile, respectively, to a base portion, and a recess extending from the base portion inwardly relative to the relevant second flank.

According to the invention, the protruding portion of the second locking element is divided, by the recess of the second locking element, into two oppositely arranged protruding sub-portions, and the recess of the first locking element is divided, by the protruding portion of the first locking element, into two oppositely arranged sub-recesses. The protruding portion of the first locking element is configured to be received in the recess of the second locking element and each protruding sub-portion of the second locking element is configured to be received in a respective sub-recess of the first locking element.

The present invention proposes a novel combination of locking elements that are relatively easy to manufacture. In addition, a triple lock function is obtained. More in particular, a first lock comprises the coupling between the protruding portion of the first locking element and the recess of the second locking element. A second lock and a third lock are formed by the respective coupling between the sub-recesses of the first locking element and the protruding sub-portions of the second locking element.

The Applicant has found that by employing the first and second locking element as defined above an appropriate locking between adjacent panels can be achieved while reducing complexity and/or costs of manufacturing the panel.

The first and/or third flank may extend substantially parallel to a normal vector of the panel. Here, it is noted that the panel of the invention is generally a flat panel having a uniform thickness that is laid flat onto a subfloor. In such case, the normal vector of the panel corresponds to the vertical direction.

The protruding portion of the first locking element can be fully arranged in the recess of the first locking element and the recess of the second locking element can be fully arranged in the protruding portion of the second locking element. In this manner, elements that are relatively easily damaged, such as the protruding portion of the first locking element, can be shielded.

The second flank of the first coupling profile may comprise a first flank portion comprising said one of a first locking element and a second locking element, and a second flank portion connecting the first flank portion to the first flank. Moreover, the second flank of the second coupling profile may comprise a fourth flank portion comprising said the other of a first locking element and a second locking element and a fifth flank portion connecting the fourth flank portion to the third flank. In some embodiments, the locking element is therefore limited to a part of the second flank. The remaining region, more in particular the second flank portion, may comprise one of a recess and a protrusion that is complementary to said recess, wherein the fifth flank portion comprises the other of a recess and a complementary protrusion. This recess and protrusion may provide an additional locking. As an example, the second flank portion may comprise a recess in the shape of a first groove, wherein the first flank portion and the third flank of the first coupling profile form a first tongue. The fifth flank portion may comprise a protrusion, which, together with the third flank of the second coupling profile, forms a second tongue and that defines, together with the first flank and fourth flank portion of the second coupling profile, a second groove. The first tongue of the panel can be configured to be received in the second groove of the adjacent panel, and the second tongue of the adjacent panel can be configured to be received in the first groove of the panel. Accordingly, the present invention also relates to a tongue-and-groove coupling in which the tongue of the first coupling profile is provided with the first or second locking element and in which the groove of the second coupling profile is provided with the other of the first or second locking element.

The second flank of the first coupling profile may comprise a third flank portion connecting the first flank portion to the third flank, and the second flank of the second coupling profile may comprise a sixth flank portion connecting the fourth flank portion to the first flank. Accordingly, the second flank of the first and second coupling profile may comprise multiple segments, which may be essentially flat or curved. When panel 1 is coupled to panel 1', the first flank portion preferably lies against the fourth flank portion, the second flank portion against the fifth flank portion, and the third flank portion against the sixth flank portion.

The third flank portion may face away from the first flank of the first coupling profile, and the fifth flank portion may face away from the first flank of the second coupling profile. For example, when the panel is arranged on the floor with the first extension region facing down, the third flank portion may, starting from its connection to the first flank portion, be inclined downwards. Similarly, the fifth flank portion may, starting from its connection to the fourth flank portion, be inclined upwards.

The third flank portion and the sixth flank portion can be essentially flat. In such case, the direction the third flank or sixth flank is facing can be determined using a normal vector of the flank. In other cases, the third or sixth flank may be curved or may comprise a plurality of interconnected segments. In such case, the direction the flank is facing can be determined using a line that is perpendicular to the line that connects the end points of the flank. Similar considerations hold for determining the direction other flanks or flank portions are facing.

As a further example, the first flank portion and the second flank portion may face substantially the same direction, and the fourth flank portion and the fifth flank portion may face substantially the same direction. As a particular example, the first flank portion and the second flank portion face a direction that is parallel to a normal vector of the panel, and the fourth flank portion and the fifth flank portion may face a direction that is parallel to said normal vector of the panel. The second flank may be shaped such that the relevant extension region, i.e. the first or second, tapers towards the end of the extension region. Alternatively, the second flank may be substantially horizontal, i.e. parallel to a top or bottom surface of the panel.

Alternatively, the second flank portion may face a different direction than the first flank portion, and the fifth flank portion may face a different direction than the fourth flank portion.

The second flank portion may be directed away from the first flank of the first coupling profile, and the fifth flank portion may be directed away from the first flank of the second coupling profile.

The present invention is not limited to second and/or fifth flank portions being flat. It equally relates to second and/or fifth flank portions being curved.

The panel may comprise a third locking element arranged on one of the first and third flank of the first coupling profile, and a fourth locking element arranged on one of the third and first flank of the second coupling profile, respectively, wherein the third and fourth locking elements are configured for the purpose of further mutually locking the panel and the adjacent panel. Preferably, the third and fourth locking elements are arranged on vertically orientated flanks to provide a locking between the panel and the adjacent panel against vertical mutual movement.

The third locking element can be configured as one of the first and second locking element and the fourth locking element can be configured as the other of the first and second locking element. Alternatively, the third locking element may comprise one of a recess and a protrusion that is complementary to said recess, and the fourth locking element may comprise the other of the recess and complementary protrusion.

The first locking element may comprise a pair of further protrusions arranged on opposite sides of the recess of the first locking element, and the second locking element may comprise a pair of further recesses arranged on opposite sides of the protruding portion of the second locking element. Each of the further recesses may be configured to receive a respective further protrusion. In this manner a five-fold locking function can be obtained.

The invention particularly relates to a laminated floor panel, wherein the core is made from at least one of medium-density fiberboard (MDF) or a high-density fiberboard (HDF). However, the invention does not exclude panels made from different materials such as poly-vinyl-chloride (PVC).

The panel may comprise a top side comprising a decorative layer and a bottom side, wherein the first extension region partially forms the bottom side and wherein the second extension region partially forms the top side.

According to a second aspect, the invention further provides a floor covering comprising a plurality of panels as above, wherein the first locking element of a given panel among the plurality of panels is coupled to the second locking element of another panel among the plurality of panels that is arranged adjacent to said given panel.

BRIEF DESCRIPTION OF THE DRAWINGS

Next, the invention will be described referring to the appended drawings wherein identical reference signs will be used to refer to identical or similar components and wherein.

DESCRIPTION OF THE INVENTION

Figure 3A:
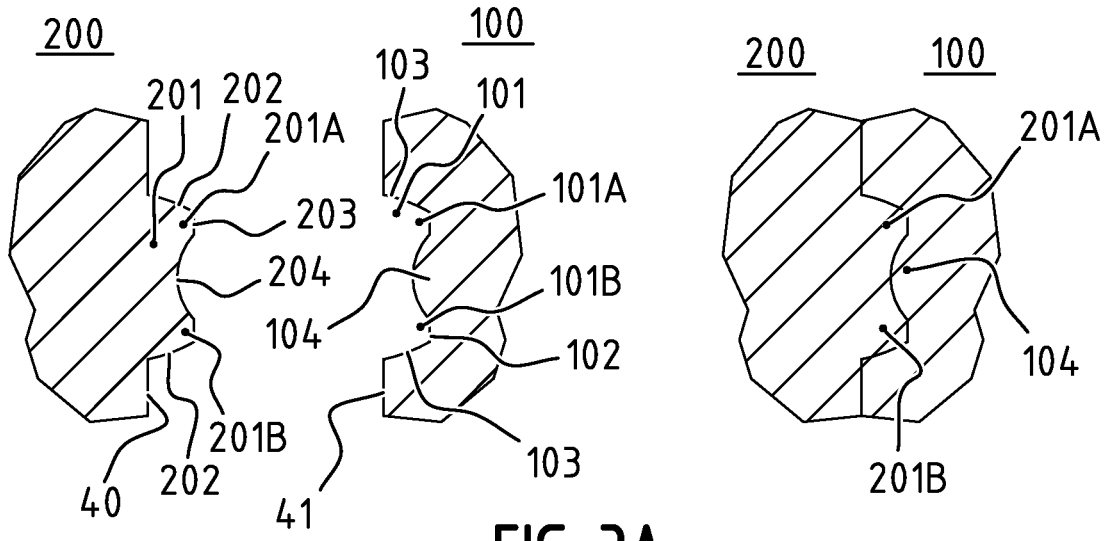
FIGS. 3A and 3B illustrate embodiments of a first and second locking element in accordance with the present invention.
Figure 3B:
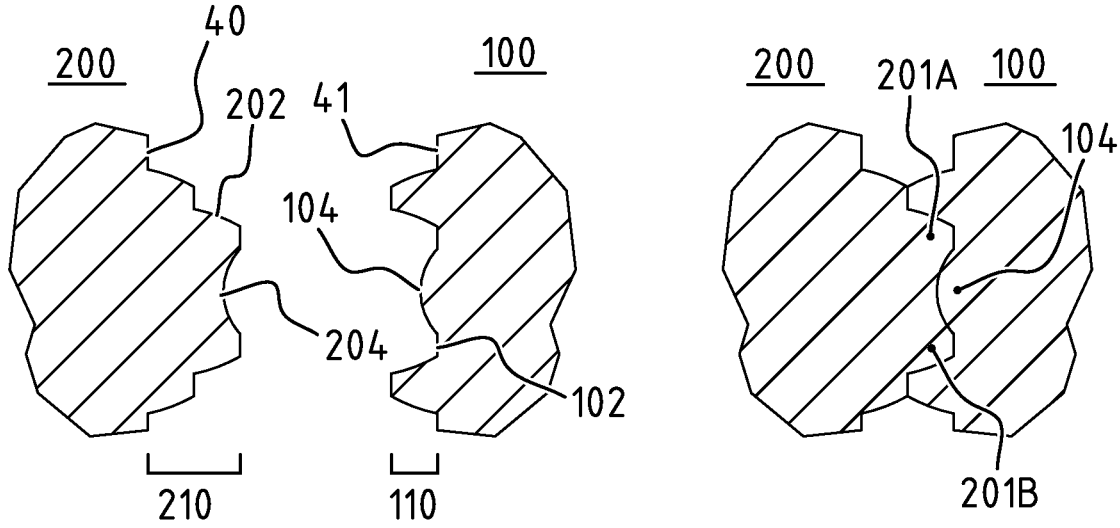

FIGS. 3A and 3B illustrate embodiments of a first and second locking element in accordance with the present invention. Here, first locking element 100 is assumed to be arranged on second flank 41 of second coupling profile 6 and comprises a recess 101 that extends inwardly relative to second flank 41. Recess 101 comprises a bottom 102 and side walls 103 extending from bottom 102 to an outside of second flank 41. First locking element 100 further comprises a protruding portion 104 extending from bottom 102 toward the outside of second flank 41. As shown, protruding portion 104 is fully arranged in recess 101.

Second locking element 200, assumed to be arranged on second flank 40 of first coupling profile 5, comprises a protruding portion 201 comprising side walls 202 that extend outwardly from an outside of second flank 40 to a base portion 203, and a recess 204 extending from base portion 203 inwardly relative to second flank 40. As shown, recess 204 is fully arranged in protruding portion 201.

Protruding portion 201 is divided, by recess 204, into oppositely arranged protruding sub-portions 201A, 201B. In addition, recess 101 is divided, by protruding portion 104, into oppositely arranged sub-recesses 101A, 101B.

As shown in the coupled state in FIG. 3A, right hand side, protruding portion 104 is received in recess 204 and each protruding sub-portion 201A, 201B is received in a respective sub-recess 101A, 101B. In this manner, a triple lock function is obtained by first and second locking elements 100, 200.

FIG. 3B illustrates a modification of first and second locking elements 100, 200 wherein first locking element 100 and second locking element 200 of FIG. 3A are each arranged in or on a respective protruding portion 110, 210. As shown, bottom 102 is substantially in line with the remaining part of second flank 41.

It should be noted that the placement of first and second locking elements 100, 200 may be reversed, i.e. first locking element 100 can be provided on second flank 40 and second locking element 200 on second flank 41.

Figure 1A:
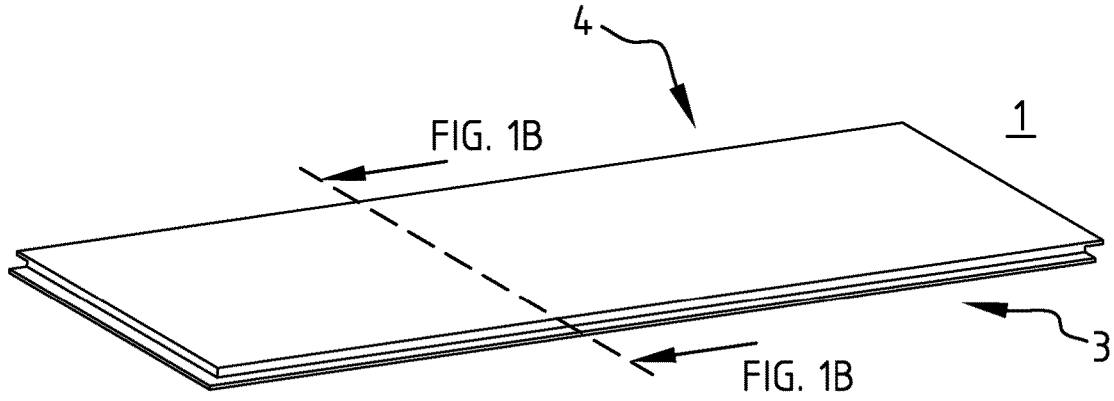
FIG. 1A PRIOR ART
FIGS. 1A and 1B illustrate a schematic perspective view and a cross-sectional view of a general panel, respectively.
Figure 1B:
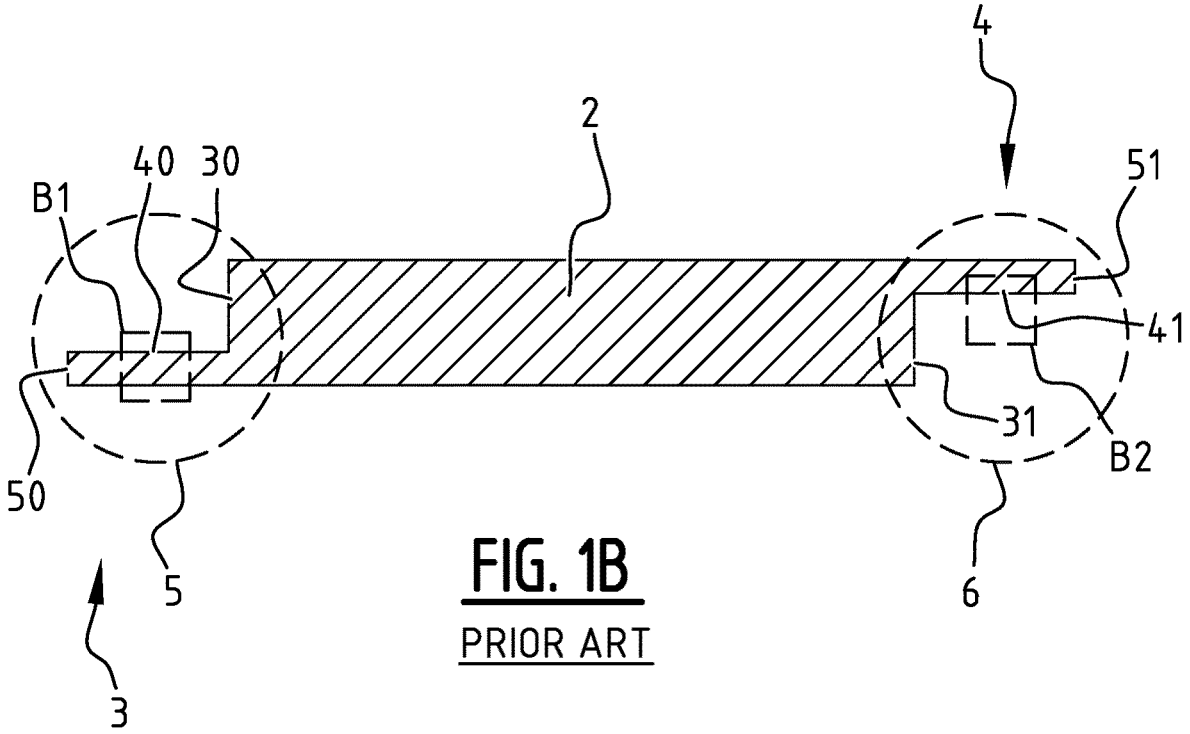
FIG. 1B PRIOR ART
Figure 2:
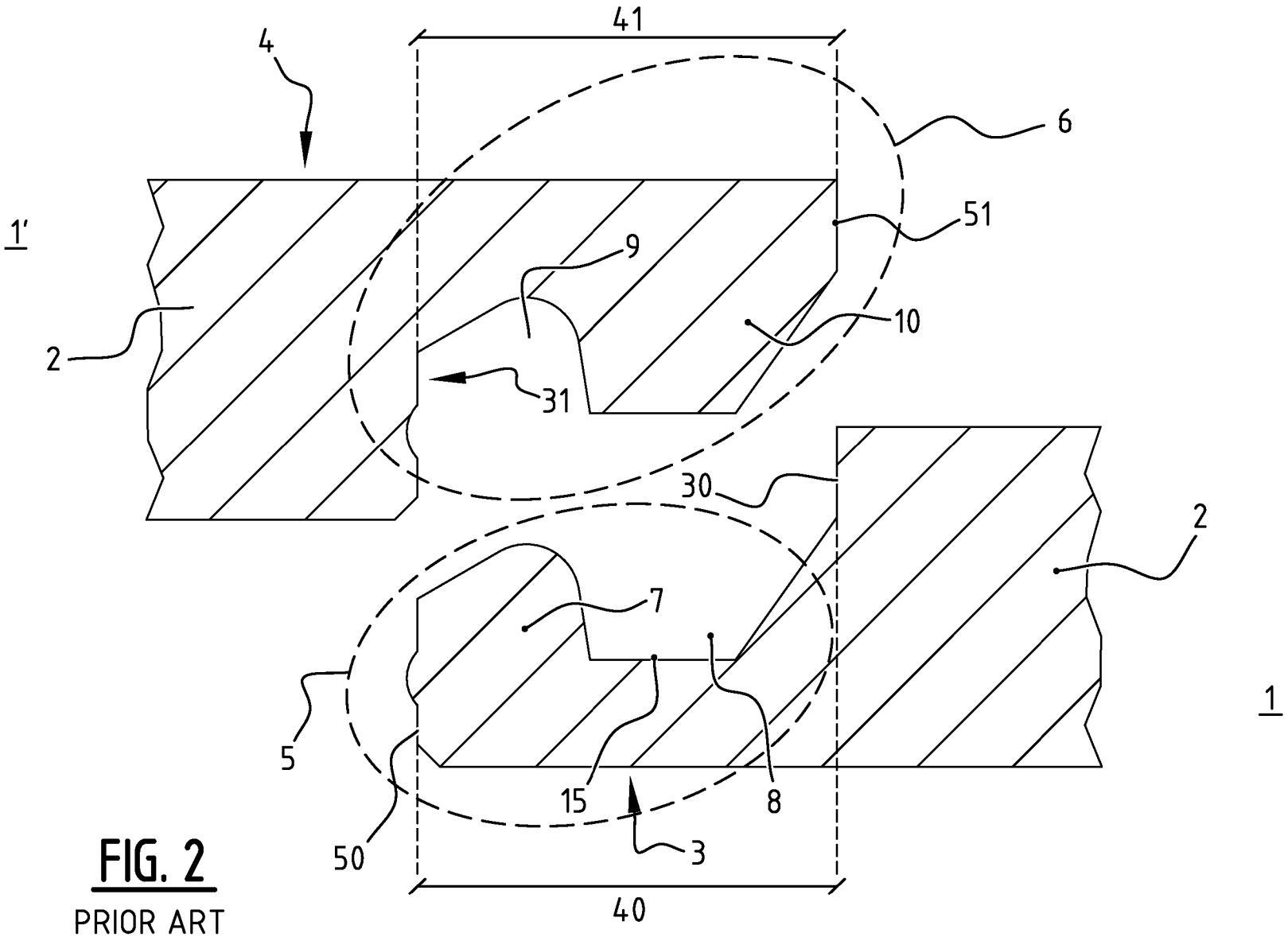
FIG. 2 PRIOR ART
FIG. 2 illustrates a cross-sectional view of a known panel.

The Applicant has found that locking elements 100, 200 provide a significantly improved locking effect when compared to a combination of a recess and protrusion as shown in FIG. 2, which are located on the first flank 31 and third flank 50, respectively. Furthermore, the Applicant realized that these locking elements can be used to replace the tongue-and-groove type of panels that are known in the art. The resulting panels are less complex and/or costly to manufacture and/or provide enhanced coupling strength. Next, examples of such panels will be presented.

Figure 4A:
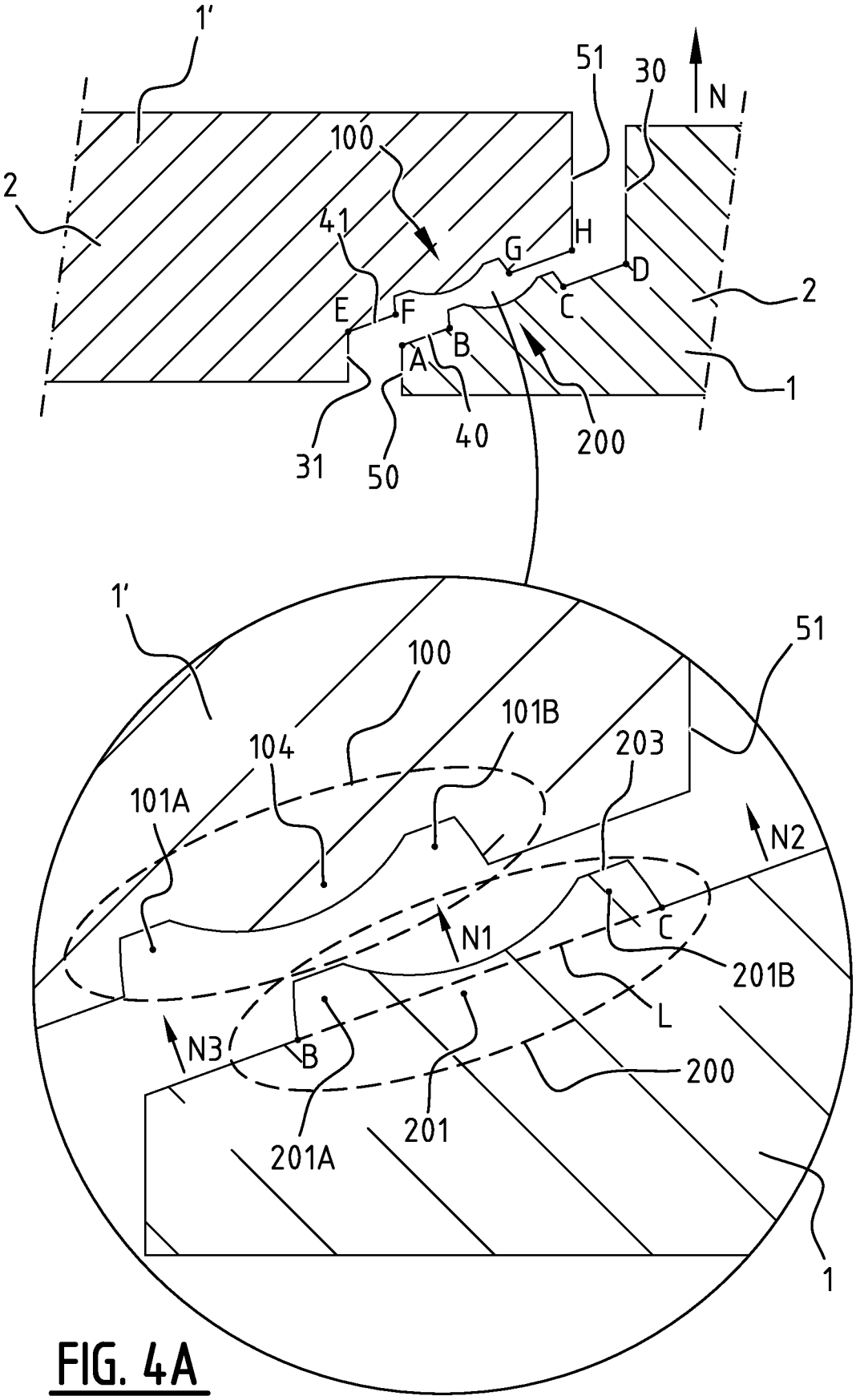
FIGS. 4A-G illustrate various embodiments of a panel in accordance with the present invention.
Figure 4B:
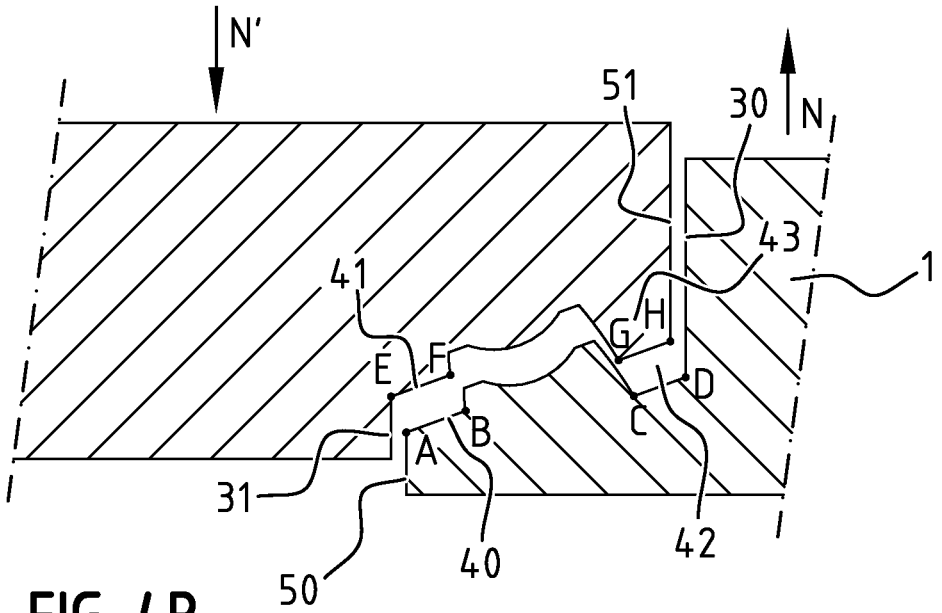
Figure 4C:
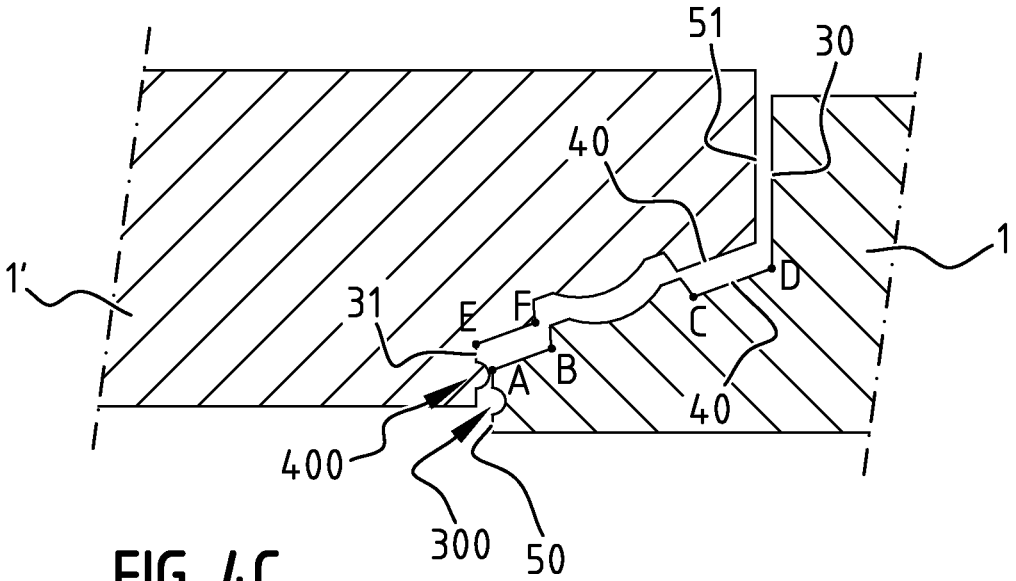

FIGS. 4A-G illustrate various embodiments of a panel in accordance with the present invention. Each figure illustrates the first coupling profile of a panel 1 next to the second coupling profile of an adjacent and identical panel 1'. Furthermore, FIGS. 4A-4C illustrate the coupling profiles in a loose state. Flank points A, B, C, D are indicated to illustrate the end points of the various portions of second flank 40. More in particular, the first flank portion extends between points B and C, the second flank portion between points C and D, and the third flank portion between points A and B. Similarly, flank points E, F, G, H are indicated to illustrate the end points of the various portions of second flank 41. More in particular, the fourth flank portion extends between points F and G, the fifth flank portion between points G and H, and the sixth flank portion between points E and F.

The orientation of a flank portion can be determined by drawing a line, e.g. line L, through the end points of the respective flank portion. A line perpendicular to this line can then be taken as the normal vector corresponding to the flank portion. This is shown in FIG. 4A where a line L is drawn through points B and C to determine the orientation of the first flank portion of second flank 40. This orientation is indicated by normal vector N1. Similar vectors N2, N3 can be drawn for the second and third flank portion, respectively.

As shown in FIG. 4A, each of the first, second, and third flank portion faces away from first flank 30. Moreover, each flank portions faces the same direction as the corresponding normal vectors are parallel. Similarly, each of the flank portions of second flank 41 faces the same direction away from first flank 31.

In the FIG. 4A embodiment, the first, second, and third flank portion are aligned as indicated by a line that passes through points A-D. More in particularly, first coupling profile has a tapered form towards the edge of panel 1, which edge is formed by third flank 50. Similarly, the fourth, fifth, and sixth flank portion are aligned as indicated by a line that passes through points E-H. The second coupling profile also has a tapered form towards the edge of panel 1', which edge is formed by third flank 51.

A first locking element 100, which was previously shown in FIG. 3A, is provided on the fourth flank portion of second flank 41. A corresponding second locking element 200, which was previously shown in FIG. 3A, is provided on the first flank portion of second flank 40.

Compared to the embodiment shown in FIG. 4A, the embodiment shown in FIG. 4B comprises a recess 42 in the second flank portion of second flank 40 of panel 1. Similarly, the fifth flank portion of second flank 41 of panel 1' comprises a protrusion 43 that is configured to be received in recess 42. The cooperation between recess 42 and protrusion 43 provides a further mutual locking between panels 1, 1'. It is however noted that a similar locking, although maybe less pronounced, is achieved in the embodiment of FIG. 4A, where the fifth flank portion, extending between points G and H, can be seen as forming a protrusion that is received in the recess that is formed between the outer-right side-wall of locking element 200 and first flank 30.

Compared to the embodiment shown in FIG. 4A, the embodiment shown in FIG. 4C comprises a fourth locking element 400, shaped as a protrusion, provided in first flank 31, and a third locking element 300, shaped as recess and provided in third flank 50. Third and fourth locking elements 300, 400 are configured to cooperate to provide a further mutual locking between panels 1, 1'.

Figure 4D:
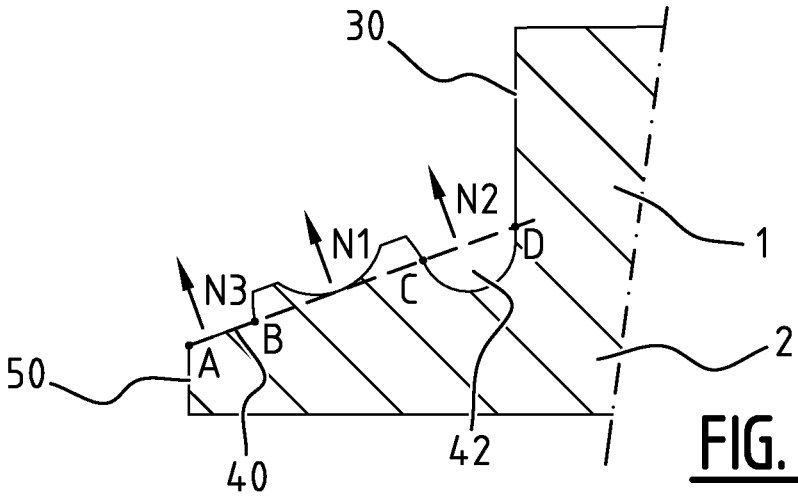

Similar to the embodiment shown in FIG. 4B, the embodiment shown in FIG. 4D comprises a recess 42 in the second flank portion of second flank 40 of panel 1. However, in this embodiment, recess 42 is rounded. Similarly, the fifth flank portion of second flank 41 of second coupling profile 6 of panel 1' comprises a rounded protrusion (not shown) that is configured to be received in recess 42.

Figure 4E:
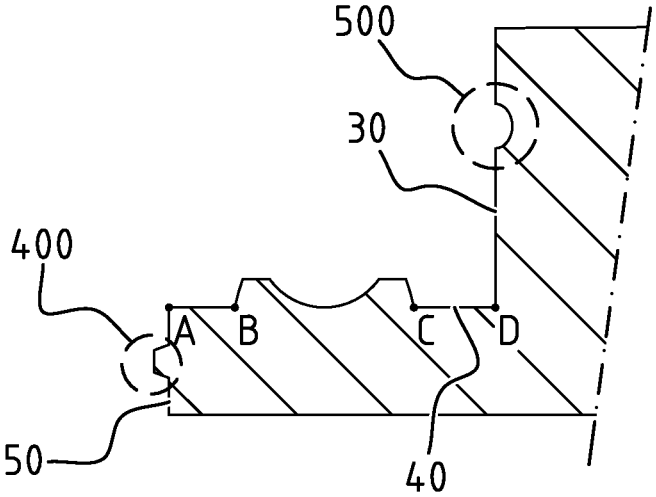

In the FIG. 4E embodiment, the first, second and third flank portions are positioned horizontally. In addition, a fifth locking element 500, in the shape of a recess, is provided on first flank 30 of first coupling profile 5 that is configured to cooperate with a sixth locking element having a shape of a protrusion and being arranged on third flank 51 of second coupling profile 6 (not shown). Fifth locking element 500 and the sixth locking element are configured to cooperate to provide a further mutual locking between panels 1, 1'.

Similar to the FIG. 4C embodiment, a third and fourth locking element 300, 400 are also provided on the third flank 50 and first flank 31 of the first and second coupling profile 5, 6, respectively. However, in this case, the position of third and fourth locking elements 300, 400 has been reversed.

Figure 4F:
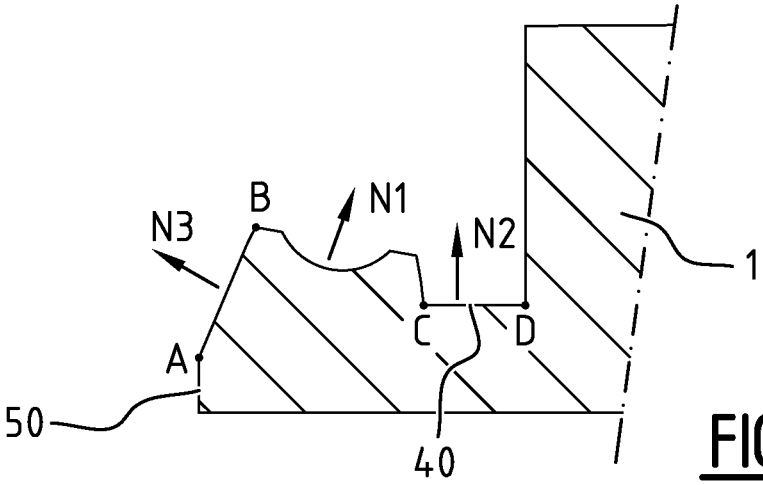

In the FIG. 4F embodiment, the first flank portion is directed towards first flank 30. The third flank portion is directed away from first flank 30, and the second flank portion is parallel to normal N of panel 1. Similarly, the fourth flank portion is directed towards first flank 31, the fifth flank portion is parallel to normal N' of panel 1', and the sixth flank portion is directed away from first flank 31.

Figure 4G:
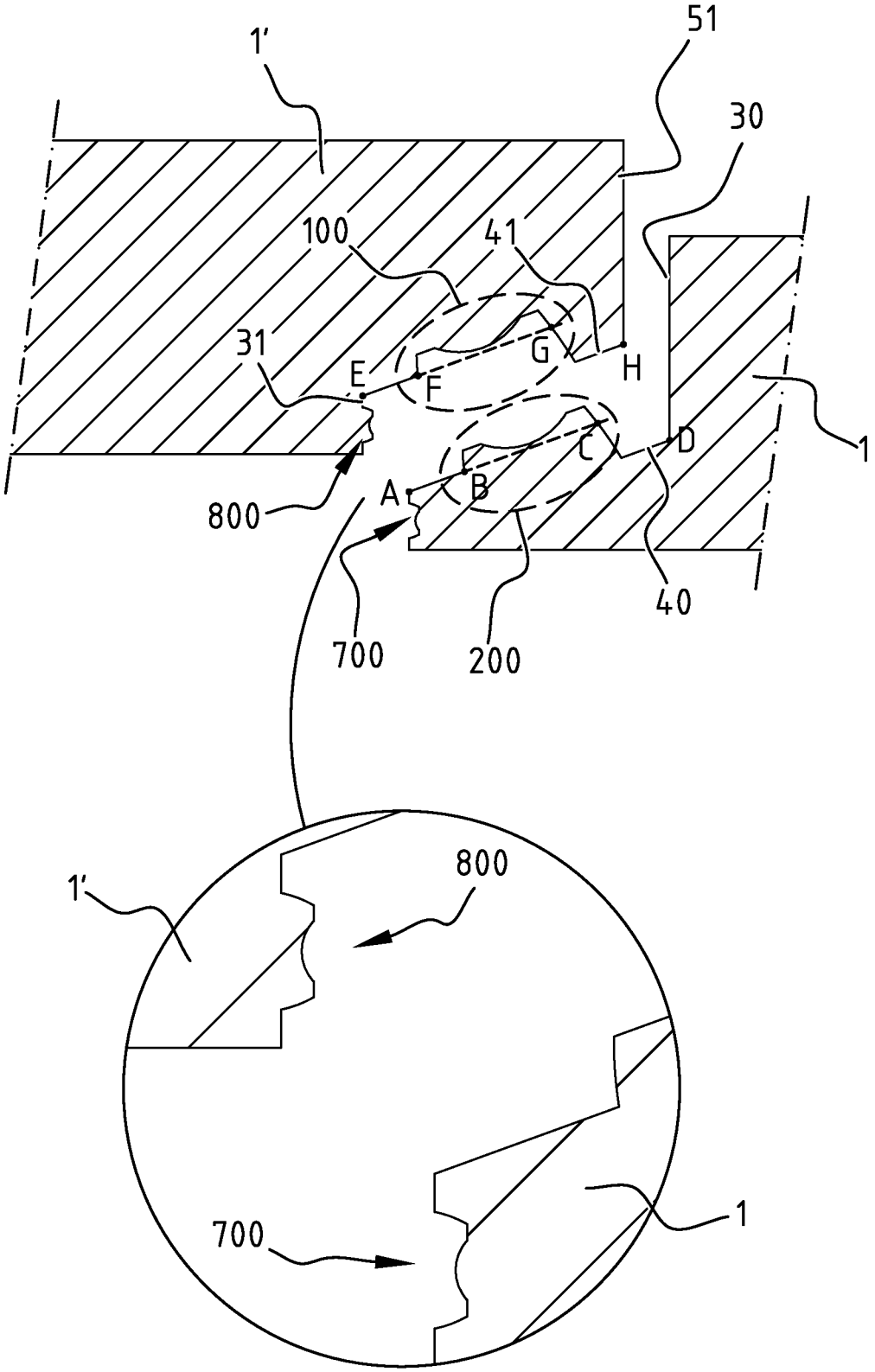

Compared to the embodiment shown in FIG. 4B, the embodiment shown in FIG. 4G comprises a seventh locking element 700 provided on third flank 30 which is shaped similar to first locking element 100 shown in FIG. 3A. Similarly, an eighth locking element 800 is provided on first flank 31 which is shaped similar to second locking element 200 shown in FIG. 3A. Seventh locking element 700 and eighth locking element 800 are configured to cooperate to provide a further mutual locking between panels 1, 1'. This particular combination of two pairs of locking elements, i.e. locking elements 100, 200 and locking elements 700, 800, wherein each of both pairs is shaped as the pair illustrated in FIG. 3, provides an improved coupling between panels 1, 1', in terms of manufacturability and/or coupling strength.

In the description above, the present invention has been explained using detailed embodiments thereof. However, the present invention is not limited to these embodiments and various modifications to the embodiments shown can be implemented without departing from the scope of the invention which is defined by the appended claims and their equivalents.

REFERENCE SIGNS

1 Panel
1' Panel
2 Core
3 First extension region
4 Second extension region
5 First coupling profile
6 Second coupling profile
7 Upward tongue
8 Upward groove
9 Downward groove
10 Downward tongue
30 First flank first coupling profile
31 First flank second coupling profile
40 Second flank first coupling profile
41 Second flank second coupling profile
42 Recess
43 Protrusion
50 Third flank first coupling profile
51 Third flank second coupling profile
100 First locking element
101 Recess first locking element
101A, 101B Sub-recesses first locking element
102 Bottom first locking element
103 Side walls first locking element
104 Protruding portion first locking element
110 Protruding portion
200 Second locking element
201 Protruding portion second locking element
201A, 201B Protruding sub-portions second locking element
202 Side walls second locking element
203 Base portion second locking element
204 Recess second locking element
210 Protruding portion
300 Third locking element
400 Fourth locking element
500 Fifth locking element
700 Seventh locking element
800 Eight locking element
A, B, C, D Flank points first coupling profile
E, F, G, H Flank points second coupling profile
B1 Dashed box illustrating first locking element
B2 Dashed box illustrating second locking element
L Line
N, N' Normal vectors panel 1, panel 1'
N1, N2, N3 Normal vectors first, second, third flank portion

The invention claimed is:

1. A panel configured to be used for constructing a floor covering that comprises a plurality of said panels, the panel comprising:

a core having a first side that is provided with a first extension region and a second side that is provided with a second extension region, wherein the first side is oppositely arranged relative to the second side, wherein the first extension region comprises a first coupling profile and wherein the second extension region comprises a second coupling profile that is complementary to the first coupling profile, wherein the first coupling profile of the panel is configured to be coupled to the second coupling profile of an adjacent panel among the plurality of panels for the purpose of mutually locking the panel and the adjacent panel;

wherein each of the first and second coupling profile comprises a first flank that forms an inner flank of the core, a third flank that forms a respective outer edge of the panel, and a second flank that connects the first and third flanks;

wherein at least the second flank of the first coupling profile comprises one of a first locking element and a second locking element, and wherein at least the second flank of the second coupling profile comprises an other of the first locking element and the second locking element, the first and second locking elements being configured to cooperate for said purpose of mutually locking the panel and the adjacent panel;

wherein, in a locked state, the first flank of the panel is configured to be aligned with the third flank of the adjacent panel, the second flank of the panel is configured to be aligned with the second flank of the adjacent panel, and the third flank of the panel is configured to be aligned with the first flank of the adjacent panel;

wherein the first locking element comprises a recess extending inwardly relative to the second flank of the first or second coupling profile, said recess having a bottom and side walls extending from the bottom to an outside of the relevant second flank, the first locking element further comprising a protruding portion extending from the bottom toward the outside of the relevant second flank;

wherein the second locking element comprises a protruding portion comprising side walls that extend outwardly from an outside of the second flank of the second or first coupling profile, respectively, to a base portion, and a recess extending from the base portion inwardly relative to the relevant second flank;

wherein the protruding portion of the second locking element is divided, by the recess of the second locking element, into two oppositely arranged protruding sub-portions;

wherein the recess of the first locking element is divided, by the protruding portion of the first locking element, into two oppositely arranged sub-recesses;

wherein the protruding portion of the first locking element is configured to be received in the recess of the second locking element;

wherein each protruding sub-portion of the second locking element is configured to be received in a respective sub-recess of the first locking element.

2. The panel according to claim 1, wherein the first flank, the third flank, or the first flank and the third flank extends substantially parallel to a normal vector of the panel.

3. The panel according to claim 1, wherein the protruding portion of the first locking element is fully arranged in the recess of the first locking element and the recess of the second locking element is fully arranged in the protruding portion of the second locking element.

4. The panel according to claim 1, wherein the second flank of the first coupling profile comprises a first flank portion comprising said one of a first locking element and a second locking element, and a second flank portion connecting the first flank portion to the first flank, and wherein the second flank of the second coupling profile comprises a fourth flank portion comprising said the other of a first locking element and a second locking element and a fifth flank portion connecting the fourth flank portion to the third flank.

5. The panel according to claim 4, wherein the second flank portion comprises one of a recess and a protrusion that is complementary to said recess, and wherein the fifth flank portion comprises the other of a recess and a complementary protrusion.

6. The panel according to claim 5, wherein the second flank portion comprises a recess in the shape of a first groove, wherein the first flank portion and the third flank of the first coupling profile form a first tongue, wherein the fifth flank portion comprises a protrusion, which, together with the third flank of the second coupling profile, forms a second tongue and that defines, together with the first flank and fourth flank portion of the second coupling profile, a second groove, wherein the first tongue of the panel is configured to be received in the second groove of the adjacent panel, and wherein the second tongue of the adjacent panel is configured to be received in the first groove of the panel.

7. The panel according to claim 4, wherein the second flank of the first coupling profile comprises a third flank portion connecting the first flank portion to the third flank, and wherein the second flank of the second coupling profile comprises a sixth flank portion connecting the fourth flank portion to the first flank.

8. The panel according to claim 7, wherein the third flank portion faces away from the first flank of the first coupling profile, and wherein the fifth flank portion faces away from the first flank of the second coupling profile.

9. The panel according to claim 7, wherein the third flank portion and the sixth flank portion are essentially flat.

10. The panel according to claim 4, wherein the first flank portion and the second flank portion face substantially the same direction, and wherein the fourth flank portion and the fifth flank portion face substantially the same direction.

11. The panel according to claim 10, wherein the first flank portion and the second flank portion face a direction that is parallel to a normal vector of the panel, and wherein the fourth flank portion and the fifth flank portion face a direction that is parallel to said normal vector of the panel.

12. The panel according to claim 4, wherein the second flank portion faces a different direction than the first flank portion, and wherein the fifth flank portion faces a different direction than the fourth flank portion.

13. The panel according to claim 4, wherein the second flank portion is directed away from the first flank of the first coupling profile, and wherein the fifth flank portion is directed away from the first flank of the second coupling profile.

14. The panel according to claim 4, wherein the second flank portion and the fifth flank portion are curved.

15. The panel according to claim 1, further comprising a third locking element arranged on one of the first and third flank of the first coupling profile, and a fourth locking element arranged on one of the third and first flank of the second coupling profile, respectively, wherein the third and fourth locking elements are configured for the purpose of further mutually locking the panel and the adjacent panel.

16. The panel according to claim 15, wherein the third locking element is configured as one of the first and second locking element and wherein the fourth locking element is configured as the other of the first and second locking element.

17. The panel according to claim 15, wherein the third locking element comprises one of a recess and a protrusion that is complementary to said recess, and wherein the fourth locking element comprises the other of the recess and complementary protrusion.

18. The panel according to claim 1, wherein the first locking element comprises a pair of further protrusions arranged on opposite sides of the recess of the first locking element, and wherein the second locking element comprises a pair of further recesses arranged on opposite sides of the protruding portion of the second locking element, wherein each of the further recesses is configured to receive a respective further protrusion.

19. The panel according to claim 1, wherein the panel is a laminated floor panel, wherein the core is made from at least one of a medium-density fiberboard (MDF) and a high-density fiberboard (HDF).

20. The panel according to claim 1, wherein the panel comprises a top side comprising a decorative layer and a bottom side, wherein the first extension region partially forms the bottom side and wherein the second extension region partially forms the top side.

21. A floor covering comprising a plurality of panels as defined in claim 1, wherein the first locking element of a given panel among the plurality of panels is coupled to the second locking element of another panel among the plurality of panels that is arranged adjacent to said given panel.

* * * * *